US005671145A

United States Patent [19]

Krebs et al.

[11] Patent Number: 5,671,145

[45] Date of Patent: Sep. 23, 1997

[54] METHOD FOR EMERGENCY CONTROL OF AN INTERNAL COMBUSTION ENGINE

[75] Inventors: Stefan Krebs, Regensburg; Wolfgang Reupke, Nittendorf-Zeiler, both of Germany

[73] Assignee: Siemens Aktiengesellschaft, Munich, Germany

[21] Appl. No.: 442,794

[22] Filed: May 17, 1995

[30] Foreign Application Priority Data

May 17, 1994 [EP] European Pat. Off. ..... 94107646

[51] Int. Cl.[6] ..... F02P 5/15

[52] U.S. Cl. ..... 364/431.04; 123/414; 123/417; 123/352

[58] Field of Search ..... 364/431.03, 431.04, 364/431.11, 431.12, 578; 123/414, 416, 417, 349, 350, 352; 73/116, 117.2, 117.3

[56] References Cited

U.S. PATENT DOCUMENTS

| | | | |
|---|---|---|---|
| 4,782,692 | 11/1988 | Peden et al. | 73/117.3 |
| 5,209,202 | 5/1993 | Maurer et al. | 123/414 |
| 5,222,110 | 6/1993 | Holzinger et al. | 377/44 |
| 5,269,274 | 12/1993 | Flaetgen et al. | 123/414 |
| 5,469,823 | 11/1995 | Ott et al. | 123/414 |

FOREIGN PATENT DOCUMENTS

| | | |
|---|---|---|
| 0 497 237 | 8/1992 | European Pat. Off. . |
| 2 637 652 | 10/1988 | France . |
| 41 25 677 | 2/1993 | Germany . |
| 41 41 714 | 7/1993 | Germany . |
| 93/07497 | 4/1993 | WIPO . |

*Primary Examiner*—Collin W. Park

*Attorney, Agent, or Firm*—Herbert L. Lerner; Laurence A. Greenberg

[57] ABSTRACT

A method for emergency control of an internal combustion engine includes simulating signals (pulses or tooth signals are reference signals) of a crankshaft transducer from certain memorized variables, in the event of a failure of the crankshaft transducer. The memorized variables are the total number of teeth, angle lengths of segments (teeth, gaps) disposed on a crankshaft transducer disk, a transit time of the segments of the crankshaft transducer disk, and memorized crankshaft positions corresponding to edges of the segments.

3 Claims, 2 Drawing Sheets

METHOD FOR EMERGENCY CONTROL OF AN INTERNAL COMBUSTION ENGINE

BACKGROUND OF THE INVENTION

FIELD OF THE INVENTION

The invention relates to a method for emergency control of an internal combustion engine with a microprocessor-controlled engine control unit, by means of segment edge or flank signals of a crankshaft transducer associated with a crankshaft of the internal combustion engine and segment edge or flank signals of a camshaft transducer associated with a camshaft of the internal combustion engine, wherein the transducers each include a stationary sensor, a crankshaft transducer disk provided with crankshaft segments, and a camshaft transducer disk provided with camshaft segments, for ascertaining certain positions of the crankshaft and the camshaft.

German Published, Non-Prosecuted Application DE 41 25 677 A1 discloses a control unit for an internal combustion engine that is capable of emergency operation. That unit requires a reference signal transducer, a crankshaft transducer, and a camshaft transducer, with a total of three sensors. The transducer disk of the camshaft transducer has one tooth segment for each cylinder of the engine, and the tooth segment for one certain cylinder is shortened while the tooth segment for another certain cylinder is lengthened. If the crankshaft transducer fails, the irregular camshaft signal is converted into a "monotonous camshaft signal" with tooth segments of equal length, and with that signal the controller continues to be operated during the emergency, at a substantially lower angular resolution. That known controller is too complicated and expensive for mass-production use. Besides three expensive sensors, it also requires precise and therefore expensive adjustment of the transducer disks to one another, without enabling a satisfactory angular resolution of the crankshaft in emergency operation.

SUMMARY OF THE INVENTION

It is accordingly an object of the invention to provide a method for emergency control of an internal combustion engine, which overcomes the hereinafore-mentioned disadvantages of the heretofore-known methods of this general type in such a way that with a camshaft transducer and a crankshaft transducer with conventional mass-produced transducer disks (for instance, a crankshaft toothed transducer disk with one or two missing teeth, a camshaft transducer disk with one segment over 180° NW [camshaft angle]=360° KW [crankshaft angle]), the engine can continue to be operated with approximately the same angular resolution in the event of failure of the crankshaft transducer, with the aid of a simulated crankshaft signal.

With the foregoing and other objects in view there is provided, in accordance with the invention, a method for controlling an internal combustion engine including a crankshaft, a crankshaft transducer being associated with the crankshaft for supplying segment edge signals and having a stationary sensor and a crankshaft transducer disk with crankshaft segments, for ascertaining certain positions of the crankshaft; a camshaft, a camshaft transducer being associated with the camshaft for supplying segment edge signals and having a stationary sensor and a camshaft transducer disk with camshaft segments, for ascertaining certain positions of the camshaft; and a microprocessor-controlled engine control unit.

The method comprises storing a total number of teeth and angle lengths of the segments disposed on the crankshaft transducer disk in nonvolatile memory; ascertaining and storing crankshaft positions (a', b') corresponding to certain camshaft segment edges, relative to a predetermined reference crankshaft position in nonvolatile memory, under predetermined operating conditions of the internal combustion engine or at predetermined intervals; ascertaining angle lengths of at least a certain portion of the segments disposed on the camshaft from the stored crankshaft positions (a', b'), and ascertaining a length ratio of at least a part of each segment to at least a part of a previous segment from the angle lengths and storing the length ratio in nonvolatile memory; ascertaining counted clock pulses ($I_N$, $I_{N-1}$) for transit times of the segments (N, N−1) in the camshaft sensor by counting out with a clock signal of predetermined frequency (where N=A and N−1=B, or vice versa), in the event of a failure of the crankshaft sensor; interpolating a number of pulses for a current segment (N) from a number ($I_{N-1}$) of clock pulses counted in a preceding segment (N−1) in accordance with a formula $I_N=I_{N-1}*(L_N/L_{N-1})$ (where $L_N$ is the angle length); and determining a number of clock pulses (I/°KW, where KW=crankshaft angle and I=pulse) per unit of a simulated crankshaft signal in advance for the current segment from the quotient $I_{N-1}/L_{N-1}$ or $I_N/L_N$.

According to one embodiment, the method further comprises subsequently simulating crankshaft signals and the crankshaft reference signal upon the appearance of the camshaft edge signal, beginning with the {a'*(I/°KW)}th pulse or the {b'*(I/°KW)}th pulse, referred to the previous reference signal, by forming a signal at each {R*(I/°KW)}th pulse of the clock signal (where R equals the spacing of two pulses from one another in °KW), and forming a crankshaft reference signal at each {360*(I/°KW)}th pulse of the clock signal.

According to another embodiment, the method comprises subsequently simulating the missing crankshaft signals and the crankshaft reference signal for the current segment (N) upon the appearance of the camshaft edge signal, beginning with the {a'*(I/°KW)}th pulse or the {b'*(I/°KW)}th pulse, referred to the previous reference signal, by generating a signal for the onset of a segment (C) at each $\{P*(L_C+L_D)*(I/°KW)\}$th pulse (I) of the clock signal; generating a signal for the beginning of a segment (D, E) at each $\{[P*(L_C+L_D)+L_C]*(I/°KW)\}$th pulse (I) of the clock signal, and generating a crankshaft reference signal (where P=0, 1, 2, . . . Z−4, Z−3) at each {360*(I/°KW)}th pulse of the clock signal.

The term "tooth" is understood below to mean both narrow teeth and wide teeth (the latter being typically referred to as segments), while the term "segment" is understood to mean both the teeth and the gaps located between each two teeth.

Other features which are considered as characteristic for the invention are set forth in the appended claims.

Although the invention is illustrated and described herein as embodied in a method for emergency control of an internal combustion engine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
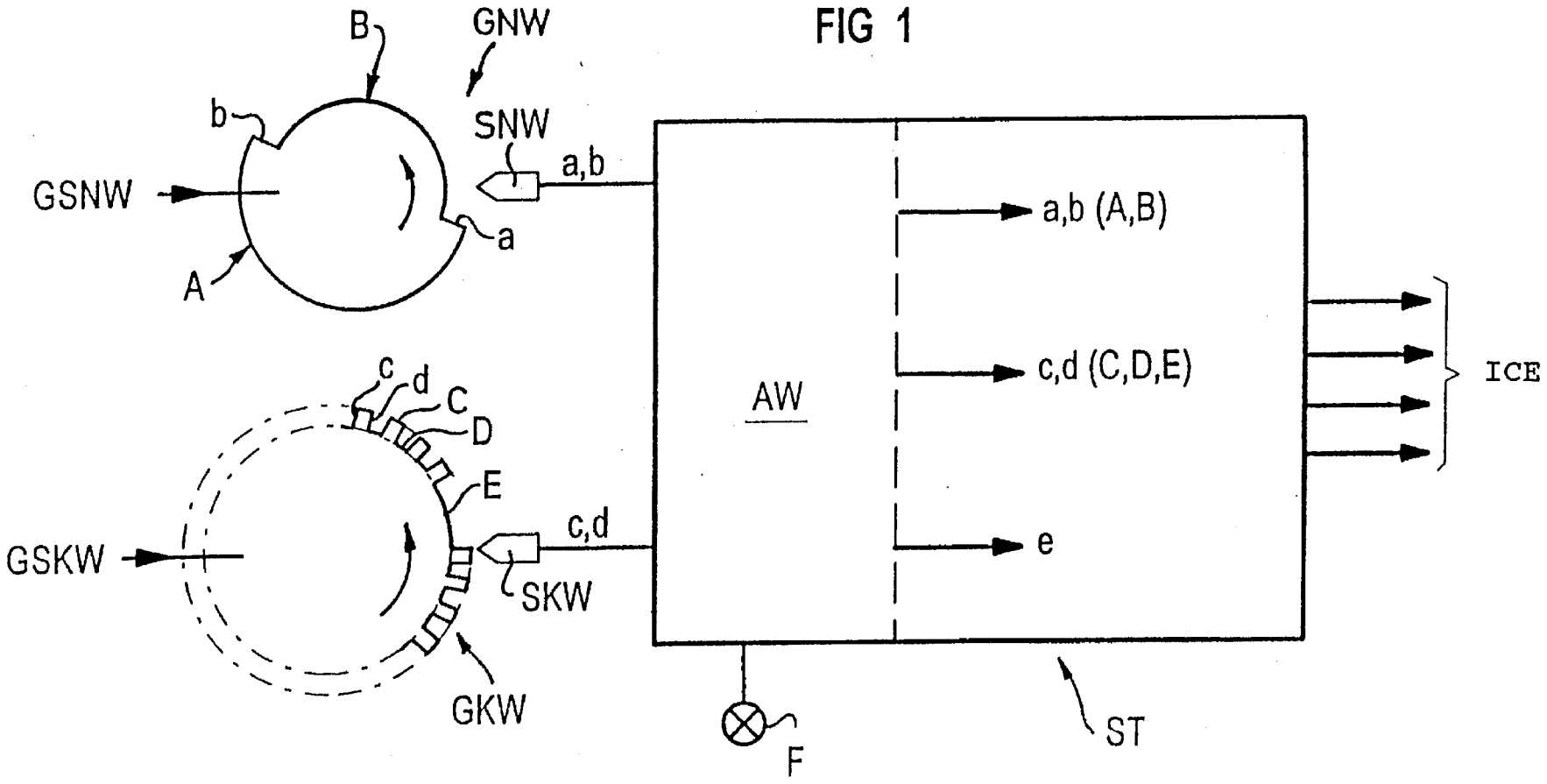
FIG. 1 is a schematic and diagrammatic view of an engine controller.

Referring now to the figures of the drawing in detail and first, particularly, to FIG. 1 thereof, there is seen an engine controller for an internal combustion engine ICE, with a microprocessor-controlled engine control unit ST to which signals of a camshaft transducer GNW and a crankshaft transducer GKW are supplied.

In this exemplary embodiment, the camshaft transducer GNW includes a fixed sensor SNW and a transducer disk GSNW, which is connected to the camshaft in such a manner as to be secured against relative rotation. The transducer disk GSNW has a tooth A and a gap B of approximately the same width. The tooth and the gap are separated from one another by an ascending edge a and a descending edge b, in accordance with a direction of rotation defined by an arrow.

In this exemplary embodiment, the crankshaft transducer GKW includes a fixed sensor SKW and a transducer disk GSKW, which is connected to the crankshaft in such a manner as to be secured against relative rotation. The transducer disk GSKW has approximately 60 teeth C of equal width which are distributed uniformly over the periphery with gaps D of equal width. Each tooth and gap are separated from one another by ascending edges c and descending edges d, in accordance with a direction of rotation defined by an arrow. Two of these teeth, number 59 and number 60, are removed, so that a gap E with five times the width is created due to the two missing teeth and the gaps thus made available.

As the transducer disks rotate, depending on the way in which the sensors are constructed (inductive or Hall sensors, etc.), they furnish corresponding signals (having reference numerals which match those of the teeth, gaps and edges corresponding to them) to a preparation circuit AW in the control unit, having output signals which in turn are employed in a known manner to control the engine. By way of example, the output signals of the preparation circuit AW may include 5 or 10 pulses per crankshaft tooth or gap (which also applies to the missing teeth), that are formed by counting out the crankshaft segments. However, they may also be an accurate reproduction of the segments disposed on the crankshaft transducer disk GSKW. The preparation circuit also generates a crankshaft reference signal e=0°KW, by comparison of the widths of the crankshaft segments C, D and E. The crankshaft reference signal is assigned, for instance, to the ascending edge c of the first tooth following the wide gap E, from which point the counting of the circumferential angle of the crankshaft is to begin.

The transit time of the camshaft segments A and B at the camshaft sensor SNW is counted out with a clock signal t of constant frequency, in order to determine the rotary speed, acceleration, and so forth of the engine therefrom.

Figures 2A, 2B, 2C, 2D:
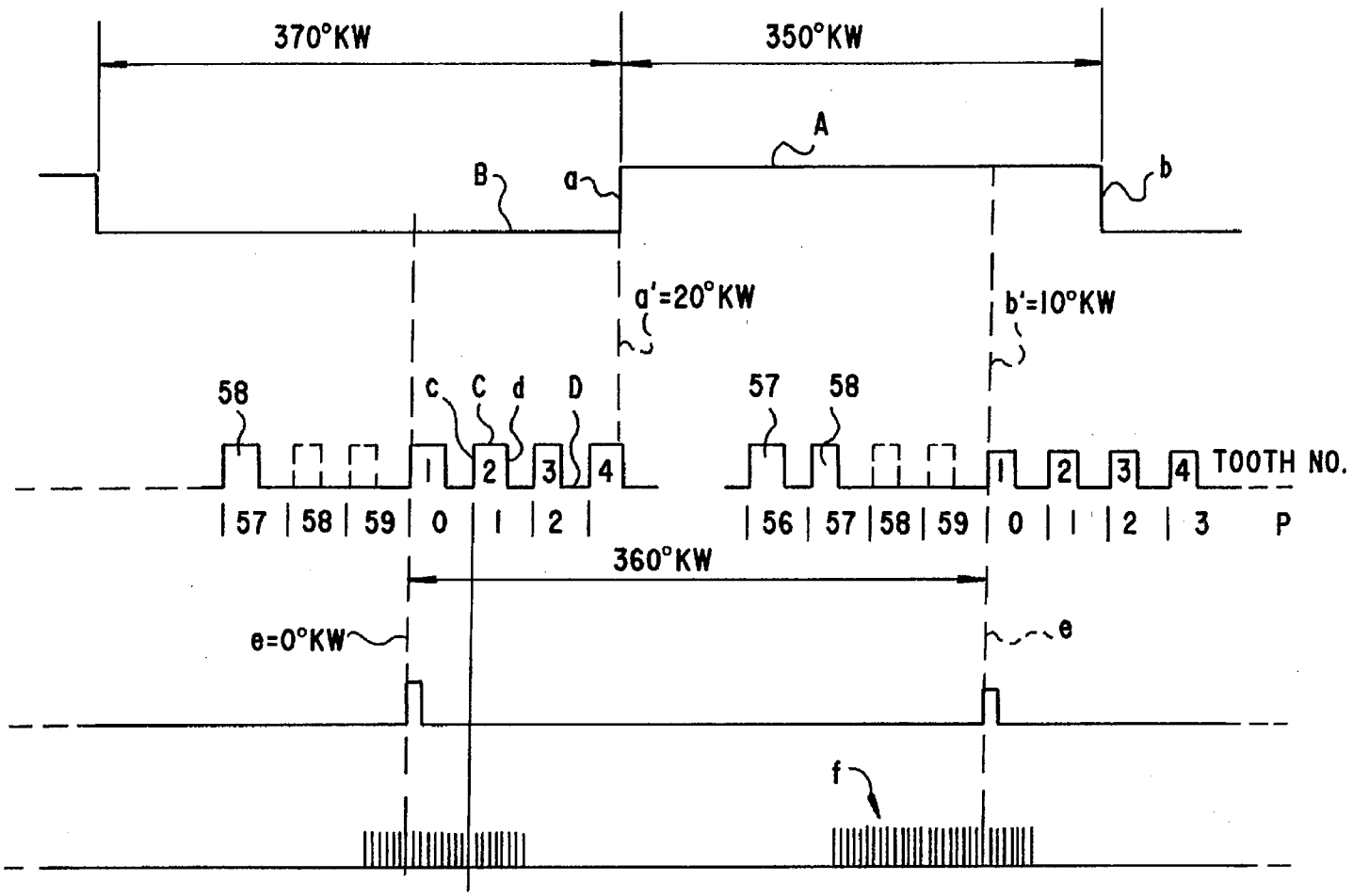
FIG. 2 is a signal diagram used to explain the functioning of the method described herein.

FIG. 2 is a diagram of the camshaft segments a, A, b, B in a part a of FIG. 2; the crankshaft segments c, C, d, D, E in a part b of FIG. 2; and the (crankshaft) reference signals e derived therefrom in a part c of FIG. 2.

A part d of FIG. 2 shows signals f derived from the crankshaft segments, which by way of example has 5 pulses per tooth or gap, including the missing teeth. However, the signals derived from the crankshaft segments may also be an accurate reproduction of the crankshaft segments c, C, d, D, E in the part b of FIG. 2.

By way of example, the reference signals e should always appear at a crankshaft position when cylinder I (and therefore also cylinder IV) is located 120° KW before top dead center. The crankshaft transducer disk GSKW is adjusted as accurately as possible to that point.

Each segment A, B of the camshaft transducer disk GSNW extends in accordance with the set point or command value over 180° NW=360° KW. However, because of allowable tolerances, the tooth A (ascending edge a) begins at 100° KW before top dead center, for instance, and the gap B (descending edge b) begins at 110° KW before top dead center.

The fixed variables, that is the total number Z=60 of teeth C (58 plus the missing two) which are present on the crankshaft transducer disk GSKW and angle lengths $L_C$ and $L_D$=360°/120=3° KW of the segments (60 tooth and 60 gaps=120 segments) disposed on the crankshaft transducer disk GSKW are stored in nonvolatile memory in the engine control unit before the engine is first put into operation.

Under predetermined operating conditions of the engine, for instance after each starting procedure or at predetermined intervals, for instance every ten minutes, crankshaft positions a' and b' at which the edges a and b of the camshaft segment pass the camshaft sensor SNW, are also stored in nonvolatile memory in the engine control unit ST. In the present exemplary embodiment, these are the values a'=20° KW (calculated from e=0° KW≡100° KW before top dead center) and b'=10° KW (≡110° KW before top dead center).

The angle lengths LA=350° KW and LB=370° KW are determined from the stored values a' and b', and ratios A/B=350/370=0.9459 . . . and B/A=1.0571 . . . are calculated from them and stored in nonvolatile memory. The stored values a', b' and the ratios A/B and B/A derived from them are updated and rewritten continually during unimpeded operation, since they may change over time from wear.

If the rare case of the crankshaft transducer becoming defective should then occur, the signals c, C, d, D, E (part b of FIG. 2) or f (part d of FIG. 2) and the reference signal e derived therefrom (part c of FIG. 2) remain absent, and the engine controller must be guided thereafter only with the signals a, A, b, B. The missing signals and the reference signal are simulated from these signals and the stored values by the method which is described below in terms of two exemplary embodiments. If the crankshaft transducer fails, an error indication F (acoustical or visual) is also activated.

The pulses $I_{N-1}$ of the clock signal t, which are counted out in order to ascertain the transit time of the previous segment N−1 (N−1=B if N=A, and vice versa) of the camshaft transducer disk GSNW, are utilized in order to precalculate (interpolate) the number of pulses $I_N$ expected to be required for the next segment N, from the formula $$I_N=I_{N-1}*(L_N/L_{N-1}).$$

The quotient $I_N/L_N$ (or $I_{N-1}/L_{N-1}$) from this value $I_N$ and the stored angle length $L_N$ gives the value I/°KW of the pulses for 1°KW. At the instantaneous engine speed, this value is assumed to be "50", for example. As referred to the previous signal e=0° KW, this means that the edge signal a appears at the {a'*(I/°KW)}th pulse (a'=20° KW, I/°KW=50), or in other words the thousandth pulse after the previous reference signal e, or the edge signal b appears at the {b'*(I/°KW)}th pulse (b'=10° KW, I/°KW=50), that is the 500th pulse after the previous reference signal e.

In other words, a counter is set to the value a'*(I°KW)=1000 when the camshaft edge signal a appears, or to the value b'*(I/°KW)=500 at the appearance of the camshaft edge signal b, and continues to count upward at the clock signal t.

If the signals f (5 pulses per segment of 3° KW) are to be simulated in the first exemplary embodiment, then after 0.6° KW each time, or in other words at the instantaneous engine speed after each 30th pulse of the clock signal (t), or in general at each {R*(I/°KW)}th pulse, from the reference signal e=0° KW on, beginning at the 1020th pulse=20.4° KW, a pulse of the signal (f) is formed, where R equals the spacing between two pulses in °KW).

In addition, at {360*I/°KW)=18,000}th pulse I of the clock signal t, a crankshaft reference signal e is output, as is seen in part c of FIG. 2.

If an identical reproduction of the crankshaft segments (part b of FIG. 2) is to be simulated in the second exemplary embodiment, then at each $$\{P*(L_C+L_D)*(I/°KW)\}th \text{ pulse } I$$

after the previous reference signal e, or in other words after 6° KW each time after e=0° KW (after each 300th pulse, beginning at 1200), a signal c (ascending edge) for the beginning of a segment C (tooth) or for the end of a signal D (gap) is output, and at each $$\{[P*(L_C+L_D)+L_C]*(I/°KW)\}th \text{ pulse } I$$

of the clock signal t, or in other words in each case 3° KW=150 pulses after each ascending edge from e=0° KW, a signal d (descending edge) for the beginning of a segment D (gap) or for the end of a segment C (tooth) is output (where P=0, 1, 2, . . . , Z–4, Z–3, even if the wide gap E is to be formed; where P=0, 1, 2, . . . , Z–2, Z–1, even if the two teeth missing from the crankshaft transducer disk GSKW are to be simulated). In addition, a crankshaft reference signal e is output (part c of FIG. 2) in this case again, at the $$\{360*(I/°KW)\}th \text{ pulse } I \ (=18{,}000)$$

of the clock signal t.

P corresponds to the integral value before the decimal point of the quotient of the particular camshaft position (in °KW, referred to e=0° KW), divided by the number 6 ($L_C+L_D$=6° KW). For instance, for the first tooth and the first gap of the crankshaft transducer disk GSKW after the reference signal (from 0° KW to <6° KW), P=0; for the second tooth and the second gap (from 6° KW to <12° KW), P=1, etc., and for the last tooth present (which is number 58, from 342° KW to <348° KW), P=(Z–3)=57.

Following the reference signal e that is generated, the counting process is begun again at the beginning, with P=0, until the next camshaft edge signal b (or a) appears at 10° KW (or 20° KW). The process described above then starts over again at the beginning.

Upon acceleration, the next camshaft edge signal a or b appears somewhat earlier, and upon deceleration somewhat later than what corresponds to the memorized camshaft edge signal a' (20° KW) or b' (10° KW).

Upon deceleration, the controller waits at the pulse number I, which would correspond to the next camshaft edge signal (b'=500, if the beginning was at a'=1000, and vice versa) while the engine speed remains the same, until this signal appears, and then begins over again, on the basis of the transit time measured for the just-ended previous camshaft segment A (or B).

Upon acceleration, that is when the next camshaft segment edge b (or A) already appears before the expected pulse number I (=500 or 1000) has been gone through, then possibly still-missing control commands are generated in succession at this edge. The method will then be started again, once again on the basis of the transit time that is measured for the just-ended prior camshaft segment A (or B).

With the method described above in terms of the two exemplary embodiments, the missing crankshaft signals are simulated or replaced in their entirety, and the controller of the engine can proceed as before the failure of the crankshaft sensor SKW. However, the driver will be informed of the error that has occurred by the visual or acoustical error indication F.

We claim:

1. In a method for controlling an internal combustion engine including:

a crankshaft, a crankshaft transducer being associated with the crankshaft for supplying segment edge signals and having a stationary sensor and a crankshaft transducer disk with crankshaft segments, for ascertaining certain positions of the crankshaft;

a camshaft, a camshaft transducer being associated with the camshaft for supplying segment edge signals and having a stationary sensor and a camshaft transducer disk with camshaft segments, for ascertaining certain positions of the camshaft; and a microprocessor-controlled engine control unit for receiving said edge signals from said crankshaft and camshaft transducers and controlling the engine based on the crankshaft signals, the method which comprises:

storing a total number of teeth and angle lengths of the segments disposed on the crankshaft transducer disk in nonvolatile memory;

ascertaining and storing crankshaft positions a',b' corresponding to respective certain camshaft segment edges, relative to a predetermined reference crankshaft position in nonvolatile memory, under predetermined operating conditions of the internal combustion engine;

ascertaining angle lengths of at least a certain portion of the segments disposed on the camshaft from the stored crankshaft positions a',b', and ascertaining a ratio of the length of each segment to at least a part of a previous segment from the angle lengths and storing the length ratio in nonvolatile memory;

ascertaining counted clock pulses ($I_N$, $I_{N-1}$) for transit times of respective segments (N, N–1) by the camshaft sensor by counting with a clock signal of predetermined frequency, in an event of a failure of the crankshaft sensor, wherein said failure is determined when no crankshaft sensor signal is detected;

interpolating a number of pulses for a current segment (N) from a number ($I_{N-1}$) of clock pulses counted in a preceding segment (N–1) in accordance with a formula $I_N=I_{N-1}*(L_N/L_{N-1})$ wherein $L_N$ and $L_{N-1}$ are respective angle lengths;

determining a number of clock pulses for a simulated crankshaft signal in advance for the current segment from the quotient $I_{N-1}/L_{N-1}$; and subsequently simulating crankshaft signals and the crankshaft reference signal upon appearance of the camshaft edge signal, beginning with one of the (a'*(I/°KW))th pulse and the (b'*(I/°KW))th pulse, referenced to the previous reference signal, by:

forming a signal at each (R*(I/°KW))th pulse of the clock signal, wherein R is the space between two pulses in °KW, and forming a crankshaft reference signal at each (360*(I/°KW))th pulse of the clock signal.

2. In a method for controlling an internal combustion engine including:

a crankshaft, a crankshaft transducer being associated with the crankshaft for supplying segment edge signals and having a stationary sensor and a crankshaft transducer disk with crankshaft segments, for ascertaining certain positions of the crankshaft;

a camshaft, a camshaft transducer being associated with the camshaft for supplying camshaft segment edge signals and having a stationary sensor and a camshaft transducer disk with camshaft segments, for ascertaining certain positions of the camshaft; and a microprocessor-controlled engine control unit for receiving said edge signals from said crankshaft and camshaft transducers and controlling the engine based on the crankshaft signals, the method which comprises:

storing a total number of teeth and angle lengths ($L_C$, $L_D$) of the segments disposed on the crankshaft transducer disk in nonvolatile memory;

ascertaining and storing crankshaft positions a',b' corresponding to certain camshaft segment edges, relative to a predetermined reference crankshaft position in nonvolatile memory, under predetermined operating conditions of the internal combustion engine or at predetermined intervals;

ascertaining angle lengths of at least a certain portion of the segments disposed on the camshaft from the stored crankshaft positions a',b', and ascertaining a ratio of the length of each segment to at least a part of a previous segment from the angle lengths and storing the length ratio in nonvolatile memory;

ascertaining counted clock pulses ($I_N$, $I_{N-1}$) for transit times of respective segments (N, N−1) by the camshaft sensor by counting with a clock signal of predetermined frequency, in an event of a failure of the crankshaft sensor, wherein said failure is determined when no crankshaft sensor signal is detected;

interpolating a number of pulses for a current segment (N) from a number ($I_{N-1}$) of clock pulses counted in a preceding segment (N−1) in accordance with a formula $I_N=I_{N-1}*(L_N/L_{N-1})$ wherein $L_N$ and $L_{N-1}$ are respective angle lengths;

determining a number of clock pulses for a simulated crankshaft signal in advance to the current segment from the quotient $I_{N-1}/L_{N-1}$ or $I_N/L_N$; and subsequently simulating the missing crankshaft signals and the crankshaft reference signal for the current segment (N) upon appearance of the camshaft edge signal, beginning with one of the (a'*(I/°KW))th pulse and the (b'*(I/°KW))th pulse, referenced to the previous reference signal, by:

generating a signal for the onset of a segment (C) at each ((P*($L_C$+$L_D$)*(I/°KW))th pulse (I) of the clock signal;

generating a signal for the beginning of a segment (D, E) at each *(I/°KW))th pulse (I) of the clock signal, and generating a crankshaft reference signal wherein P=0, 1, 2, . . . Z−4, Z−3 at each (360*(I/°KW))th pulse of the clock signal.

3. In a method for controlling an internal combustion engine including:

a crankshaft, a crankshaft transducer being associated with the crankshaft for supplying segment edge signals and having a stationary sensor and a crankshaft transducer disk with crankshaft segments, for ascertaining certain positions of the crankshaft;

a camshaft, a camshaft transducer being associated with the camshaft for supplying segment edge signals and having a stationary sensor and a camshaft transducer disk with camshaft segments, for ascertaining certain positions of the camshaft; and a microprocessor-controlled engine control unit for receiving said edge signals from said crankshaft and camshaft transducers and controlling the engine based on the crankshaft signals, the method which comprises:

storing a total number of teeth and angle lengths of the segments disposed on the crankshaft transducer disk in nonvolatile memory;

ascertaining and storing crankshaft positions a', b' corresponding to respective camshaft segment edges, relative to a predetermined reference crankshaft position in nonvolatile memory, under predetermined operating conditions of the internal combustion engine at predetermined intervals;

ascertaining angle lengths of at least a certain portion of the segments disposed on the camshaft from the stored crankshaft positions, and ascertaining a ratio of the length of each segment to at least a part of a previous segment from the angle lengths and storing the length ratio in nonvolatile memory;

ascertaining counted clock pulses $I_N$, $I_{N-1}$ for transit times of respective segments (N, N−1) by the camshaft sensor by counting with a clock signal of predetermined frequency, in an event of a failure of the crankshaft sensor, wherein said failure is determined when no crankshaft sensor signal is detected;

interpolating a number of pulses for a current segment (N) from a number ($I_{N-1}$) of clock pulses counted in a preceding segment (N−1) in accordance with a formula $I_N=I_{N-1}*(L_N/L_{N-1})$ wherein $L_N$ and $L_{N-1}$ are respective angle lengths;

determining a number of clock pulses for a simulated crankshaft signal in advance for the current segment from the quotient $I_{N-1}/L_{N-1}$; and subsequently simulating crankshaft signals and the crankshaft reference signal upon appearance of the camshaft edge signal, beginning with one of the (a'*(I/°KW))th pulse and the (b'*(I/°KW))th pulse, referenced to the previous reference signal, by:

forming a signal at each (R*(I/°KW))th pulse of the clock signal, where R equals the spacing of two pulses from one another in °KW, and forming a crankshaft reference signal at each (360*(I/°KW))th pulse of the clock signal.

* * * * *